US012351933B2

(12) United States Patent
Tsuji et al.

(10) Patent No.: US 12,351,933 B2
(45) Date of Patent: Jul. 8, 2025

(54) PLATING METHOD AND PLATING APPARATUS

(71) Applicant: EBARA CORPORATION, Tokyo (JP)

(72) Inventors: Kazuhito Tsuji, Tokyo (JP); Kentaro Yamamoto, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 18/275,879

(22) PCT Filed: Aug. 2, 2022

(86) PCT No.: PCT/JP2022/029628
§ 371 (c)(1),
(2) Date: Aug. 4, 2023

(87) PCT Pub. No.: WO2024/028973
PCT Pub. Date: Feb. 8, 2024

(65) Prior Publication Data

US 2025/0011966 A1 Jan. 9, 2025

(51) Int. Cl.

| | |
|---|---|
| ***C23C 18/16*** | (2006.01) |
| ***C25D 5/00*** | (2006.01) |
| ***C25D 5/34*** | (2006.01) |
| ***C25D 17/06*** | (2006.01) |
| ***C25D 21/08*** | (2006.01) |
| ***C25D 21/10*** | (2006.01) |
| ***C25D 21/12*** | (2006.01) |

(52) U.S. Cl.
CPC ..... *C25D 21/10* (2013.01); *C25D 5/34* (2013.01); *C25D 17/06* (2013.01); *C25D 21/08* (2013.01); *C25D 21/12* (2013.01)

(58) Field of Classification Search
CPC ..... C23C 18/1601; C25D 5/00
USPC ..... 427/430.1; 205/80
See application file for complete search history.

(56) References Cited

U.S. PATENT DOCUMENTS

2014/0097088 A1* 4/2014 Stowell ..... C25D 21/04 205/99
2017/0056934 A1 3/2017 Wang et al.
2022/0396897 A1 12/2022 Chang et al.

FOREIGN PATENT DOCUMENTS

JP 6934127 B1 9/2021
JP 7047200 B1 4/2022
(Continued)

*Primary Examiner* — Edna Wong
(74) *Attorney, Agent, or Firm* — BakerHostetler

(57) ABSTRACT

A plating method is a plating method for performing a plating process of a substrate with a plating apparatus including a substrate holder including a contact member that conductively contacts the substrate, and includes a step of rotating the substrate holder at a first rotation speed while the substrate holder is tilted, a step of performing discharging of liquid toward the substrate holder rotating at the first rotation speed to supply the liquid to the contact member, a step of stopping the discharging of the liquid, a step of starting decrease of tilt of the substrate holder to a horizontal position concurrently with or within a predetermined time before or after stopping the discharging of the liquid, a step of rotating the substrate holder at a second rotation speed higher than the first rotation speed while the substrate holder is at the horizontal position, and a step of performing the plating process on the substrate after the substrate is attached to the substrate holder.

10 Claims, 14 Drawing Sheets

(56) References Cited

FOREIGN PATENT DOCUMENTS

| | | | | |
|---|---|---|---|---|
| JP | 7081063 | B1 | 6/2022 | |
| JP | 7089133 | B1 | 6/2022 | |
| WO | WO-2022137339 | A1 * | 6/2022 | ..... C25D 17/06 |
| WO | WO 2023/067650 | A1 | 4/2023 | |
| WO | WO 2023/079632 | A1 | 5/2023 | |
| WO | WO 2023/079634 | A1 | 5/2023 | |

* cited by examiner

440

400

PLATING METHOD AND PLATING APPARATUS

CROSS-REFERENCE TO RELATED APPLICATIONS

This application is a U.S. national phase application of International Patent Application No. PCT/JP2022/029628 filed Aug. 2, 2022, which is incorporated by reference in its entirety for any and all purposes.

TECHNICAL FIELD

The present invention relates to a plating method and a plating apparatus.

BACKGROUND ART

As an example of a plating apparatus, a cup type electrolytically plating apparatus is known. In the cup type electrolytically plating apparatus, a substrate (for example, a semiconductor wafer) held by a substrate holder with a surface to be plated being oriented downward is immersed into a plating solution, and a voltage is applied between the substrate and an anode, thereby precipitating an electrically conductive film on a substrate surface (see PTLs 1 and 2).

A contact member for supplying power in contact with the substrate is provided in a substrate holder of such a plating apparatus. Further, the substrate holder includes a sealing member that performs sealing to prevent the contact member from being brought into contact with the plating solution during a plating process.

CITATION LIST

Patent Literature

PTL 1: Japanese Patent No. 7047200
PTL 2: Japanese Patent No. 7081063
PTL 3: U.S. Patent Application Publication No. US2017/0056934A1

SUMMARY OF INVENTION

Technical Problem

If dirt is present on a contact member or a plating solution adheres thereto, power supply variation occurs during a plating process, and uniformity of a thickness of formed plating decreases. In PTL 3, a cleaning device that sprays a cleaning solution onto an electric contact is described. In PTLs 1 and 2, the entire contact member is uniformly wetted with the cleaning solution, so that any power supply variation does not occur during the plating process. It is desirable that the power supply variation during the plating process can be reduced more reliably without requiring any complicated work.

The present invention has been made in view of the above problems. One object of the present invention is to provide a plating method and a plating apparatus that can reduce power supply variation during a plating process more reliably without requiring any complicated work and improve uniformity of a thickness of plating formed on a substrate.

Solution to Problem

According to one embodiment of the present invention, a plating method is provided for performing a plating process of a substrate with a plating apparatus including a substrate holder including a contact member that conductively contacts the substrate. The plating method includes a step of tilting the substrate holder, a step of rotating the substrate holder at a first rotation speed while the substrate holder is tilted, a step of performing discharging of liquid toward the substrate holder rotating at the first rotation speed to supply the liquid to the contact member, a step of stopping the discharging of the liquid, a step of starting decrease of tilt of the substrate holder to a horizontal position concurrently with or within a predetermined time before or after stopping the discharging of the liquid, a step of rotating the substrate holder at a second rotation speed higher than the first rotation speed while the substrate holder is at the horizontal position, a step of stopping rotation of the substrate holder at the second rotation speed, a step of attaching the substrate to the substrate holder that is stopped from being rotated, and a step of performing the plating process on the attached substrate.

According to another embodiment of the present invention, a plating apparatus is provided including a substrate holder including a contact member that is in conductive contact with a substrate, and a control device. The control device of the plating apparatus is configured to tilt the substrate holder, rotate the substrate holder at a first rotation speed while the substrate holder is tilted, perform discharging of liquid toward the substrate holder rotating at the first rotation speed to supply the liquid to the contact member, stop the discharging of the liquid, start decrease of tilt of the substrate holder to a horizontal position concurrently with or within a predetermined time before or after stopping the discharging of the liquid, rotate the substrate holder at a second rotation speed higher than the first rotation speed while the substrate holder is at the horizontal position, stop rotation of the substrate holder at the second rotation speed, attach the substrate to the substrate holder that is stopped from being rotated, and perform the plating process on the attached substrate.

DESCRIPTION OF EMBODIMENTS

Figure 1:
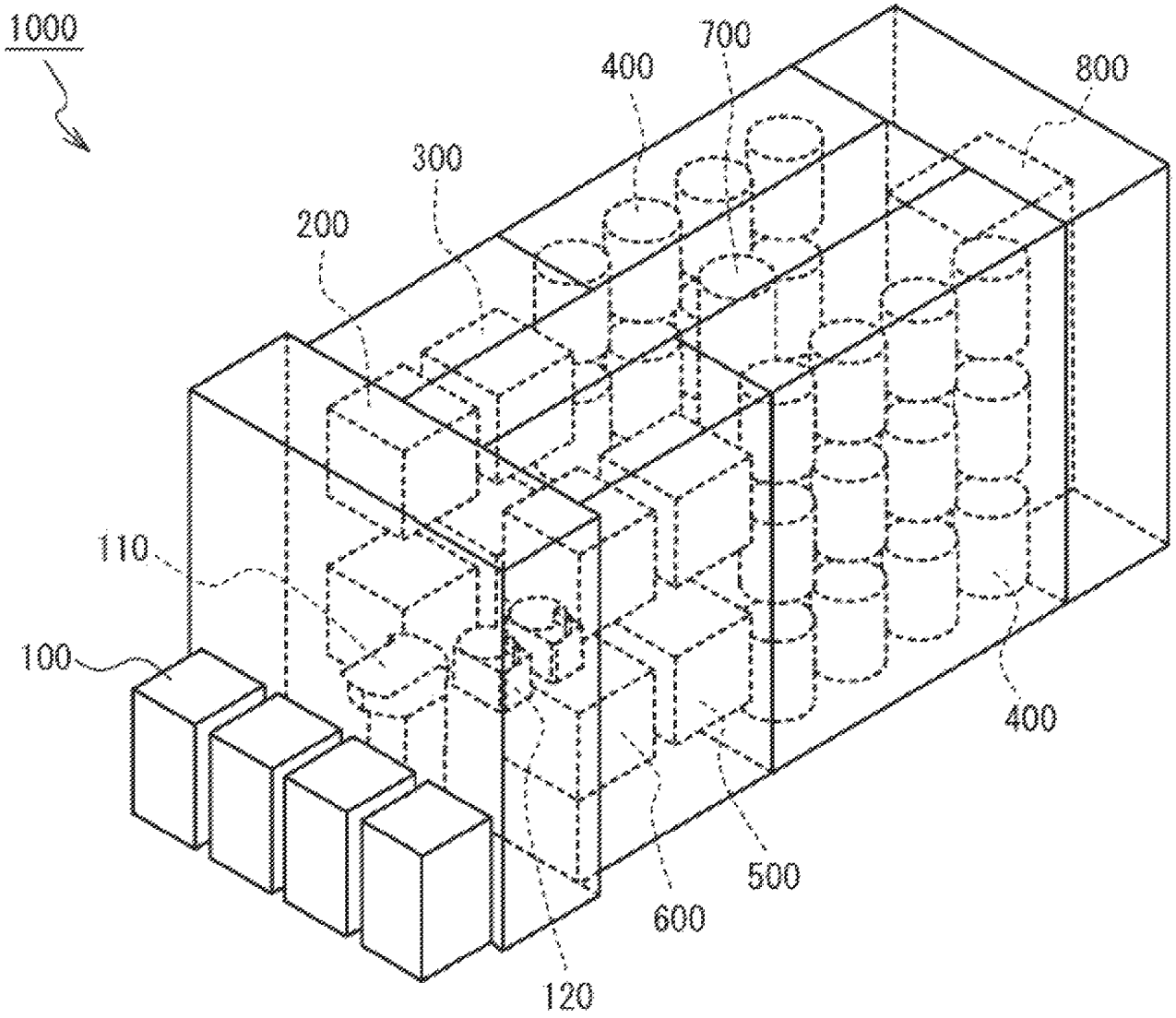
FIG. 1 is a perspective view illustrating an overall configuration of a plating apparatus of an embodiment of the present invention.

Hereinafter, embodiments of the present invention will be described with reference to the drawings. In the drawings described below, the same or corresponding components are denoted with the same reference sign and will not be described in duplicate.

Overall Configuration of Plating Apparatus

Figure 2:
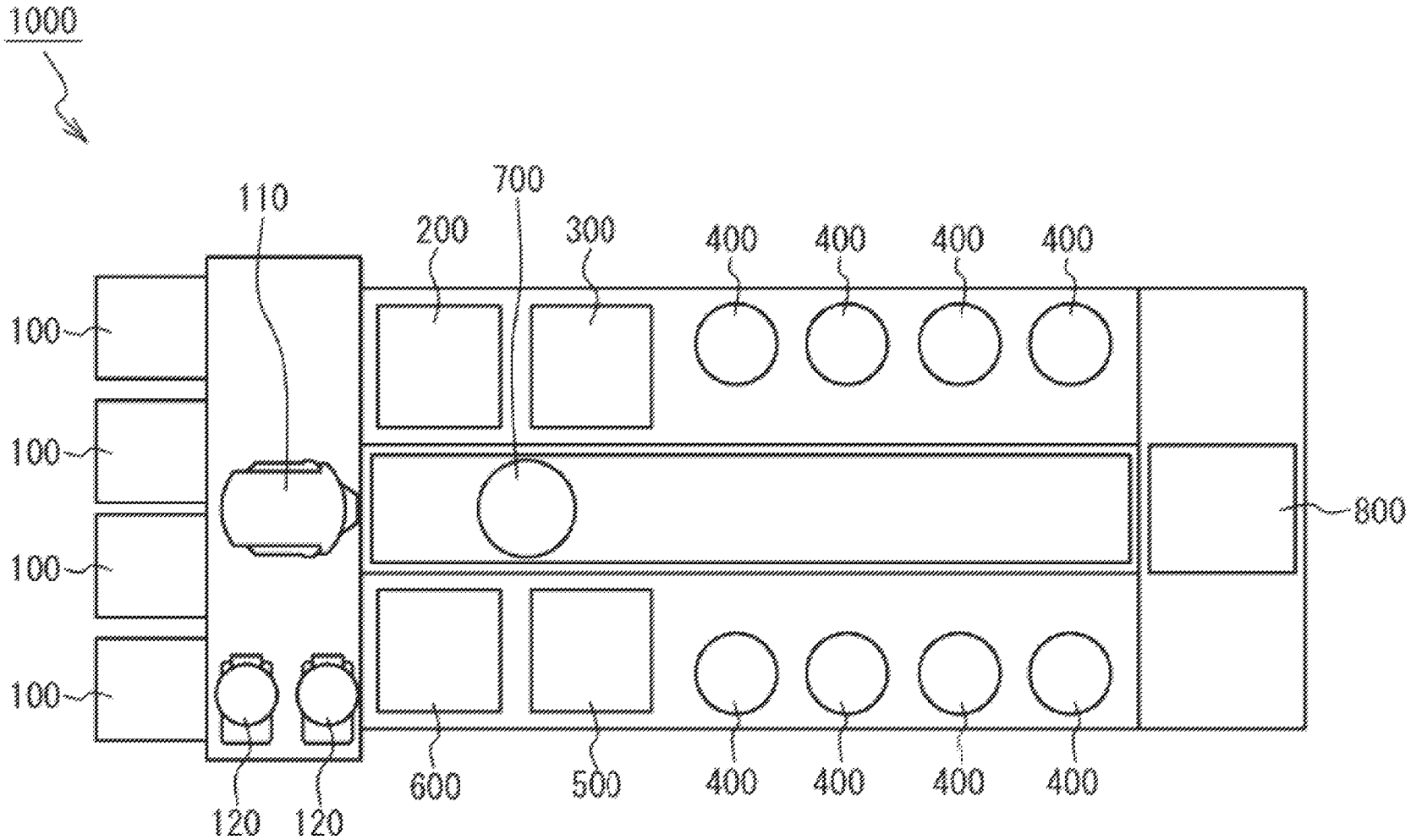
FIG. 2 is a plan view illustrating the overall configuration of the plating apparatus of the present embodiment.

FIG. 1 is a perspective view illustrating the overall configuration of a plating apparatus 1000 of this embodiment. FIG. 2 is a plan view illustrating the overall configuration of the plating apparatus 1000 of this embodiment. As illustrated in FIGS. 1 and 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid (pre-wet liquid), such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on, a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110.

The transfer robot 110 transfers the substrate received from the transfer device 700 to the cassette at the load port 100. Finally, the cassette housing the substrate is unloaded from the load port 100.

Configuration of Plating Module

Figure 3:
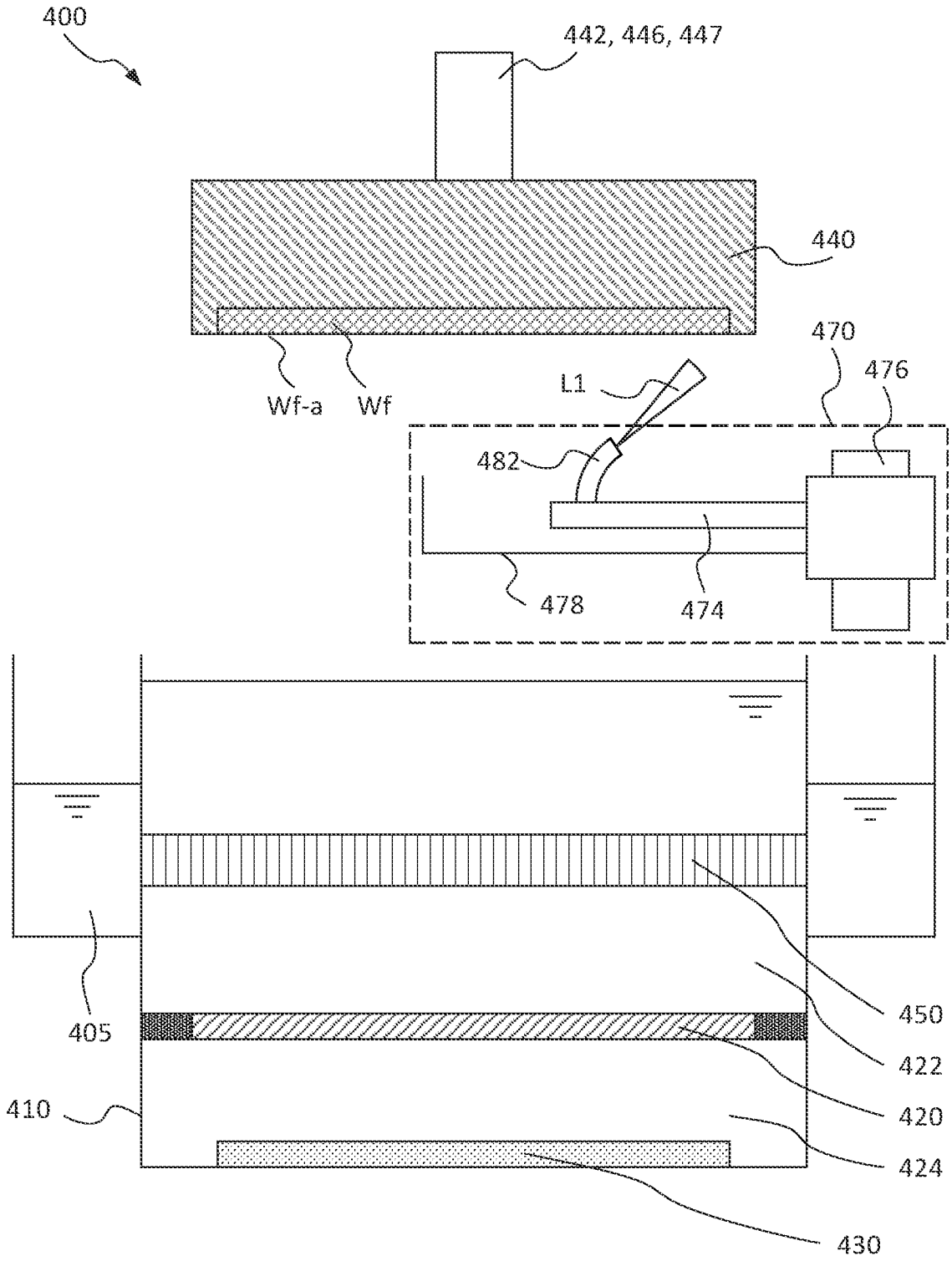
FIG. 3 is a longitudinal sectional view schematically illustrating a configuration of a plating module of the present embodiment.

Next, a configuration of the plating module 400 will be described. Since 24 plating modules 400 in the present embodiment have the same configuration, one plating module 400 alone will be described. FIG. 3 is a longitudinal sectional view schematically illustrating the configuration of the plating module 400 of the present embodiment. As illustrated in FIG. 3, the plating module 400 includes a plating tank 410 for storing a plating solution. The plating tank 410 is a container including a cylindrical side wall and a round bottom wall, and has an upper part formed with a round opening. The plating module 400 also includes an overflow tank 405 disposed outside the upper opening of the plating tank 410. The overflow tank 405 is a container for receiving the plating solution overflown from the upper opening of the plating tank 410.

The plating module 400 includes a membrane 420 that separates an inside of the plating tank 410 in an up-down direction. The inside of the plating tank 410 is divided into a cathode region 422 and an anode region 424 by the membrane 420. The cathode region 422 and the anode region 424 are each filled with the plating solution. On a bottom surface of the plating tank 410 of the anode region 424, an anode 430 is provided. In the cathode region 422, a resistor 450 opposing the membrane 420 is disposed. The resistor 450 is a member for uniformly performing the plating process in a surface to be plated Wf-a of a substrate Wf and is composed of a plate-shaped member including a large number of holes formed therein. While the plating process can be performed with desired accuracy, the resistor 450 need not be disposed in the plating tank 410.

The plating solution may be a solution containing ions of metal elements constituting a plating film, and specific examples thereof are not particularly limited. As an example of the plating process, copper plating can be used, and as an example of plating solution, copper sulfate solution can be used. In the present embodiment, the plating solution contains a predetermined additive. However, the present invention is not limited to this configuration, and the plating solution may be configured to contain no additives.

A specific type of anode 430 is not particularly limited, and a dissolved anode or an insoluble anode may be used. In the present embodiment, the insoluble anode is used as the anode 430. The specific type of insoluble anode is not particularly limited, and platinum, iridium oxide, or the like may be used.

The plating module 400 includes a substrate holder 440 for holding the substrate Wf with the surface to be plated Wf-a being oriented downward. The plating module 400 includes a first elevating/lowering mechanism 442 for elevating and lowering the substrate holder 440. The first elevating/lowering mechanism 442 can be achieved by a known mechanism such as a direct-acting actuator. The plating module 400 includes a rotation mechanism 446 for rotating the substrate holder 440 so that the substrate Wf rotates about a virtual rotation axis extending perpendicularly in the center of the surface to be plated Wf-a. The rotation mechanism 446 can be achieved by a known mechanism such as a motor.

The plating module 400 is configured to immerse the substrate Wf in the plating solution of the cathode region 422 by use of the first elevating/lowering mechanism 442 and apply a voltage between the anode 430 and the substrate Wf while rotating the substrate Wf by use of the rotation mechanism 446, thereby performing the plating process on the surface to be plated Wf-a of the substrate Wf.

The plating module 400 also includes a tilting mechanism 447 configured to tilt the substrate holder 440. The tilting mechanism 447 can be achieved by a known mechanism such as a tilt mechanism.

The plating module 400 includes a liquid supply device 470 that supplies liquid L1 to a contact member described later on the substrate holder 440. The liquid supply device 470 is configured to supply the liquid L1 to the contact member by discharging the liquid L1 toward the substrate holder 440. The liquid L1 supplied to the contact member is configured to coat at least a part of the contact member. The liquid supply device 470 includes an arm 474, a drive mechanism 476, a tray member 478, and a liquid supply nozzle 482.

The liquid L1 has a composition that is not particularly limited while having an effect of protecting the contact member. It is preferable that the liquid L1 has an electrical conductivity with a value equal to or less than a predetermined value or is deaerated.

The electrical conductivity of the liquid L1 is preferably 50 μS/cm or less, and more preferably 10 μS/cm or less. When liquid having a high electrical conductivity is present around the contact member and the substrate Wf, in addition to a current passing through a contact portion between the contact member and the substrate Wf, a shunt current may flow between a seed layer of the substrate Wf and the contact member through the liquid without passing through the contact portion. In this case, the seed layer becomes thinner due to ionization and melt-out of copper in the seed layer, or the like, to increase the electrical resistance, thereby causing power supply variation. If the electrical conductivity of the liquid L1 is low, such power supply variation can be suppressed. For details on the shunt current, refer to PTL 2 described above.

If oxygen-containing liquid is present around the contact member and the substrate Wf, oxygen is ionized and local battery effect might occur in which the seed layer melts out into the liquid. For example, copper in the seed layer gives electrons to dissolved oxygen, and hydroxide ions are generated from dissolved oxygen, while copper melts out as copper ions. Due to the local battery effect, the seed layer may become thinner, to increase the electrical resistance, thereby causing the power supply variation. If the liquid L1 is deaerated, such power supply variation can be suppressed. For details on the local battery effect, refer to PTL 2 described above.

From these viewpoints, the liquid L1 is more preferably pure water, deionized water, or deaerated water.

The liquid supply nozzle 482 discharges the liquid L1. The liquid supply nozzle 482 discharges the liquid L1 for coating the contact member and may appropriately discharge the liquid L1 as a cleaning solution to clean the contact member. An unillustrated pipe is connected to the liquid supply nozzle 482, and the liquid supply nozzle 482 discharges the liquid L1 introduced and supplied via the pipe from an unillustrated liquid source. The supply of the liquid L1 by use of the liquid supply device 470 will be described later in detail.

The liquid supply device 470 includes the drive mechanism 476 configured to turn the arm 474. The drive mechanism 476 can be achieved by a known mechanism such as a motor. The arm 474 is a plate-shaped member extending from the drive mechanism 476 in the horizontal direction. The liquid supply nozzle 482 is held on the arm 474. The drive mechanism 476 turns the arm 474 to move the liquid supply nozzle 482 between a supply position between the plating tank 410 and the substrate holder 440 and a retracted position retracted from between the plating tank 410 and the substrate holder 440.

The liquid supply device 470 includes the tray member 478 disposed below the liquid supply nozzle 482. The tray member 478 is configured to receive the liquid L1 that has dropped after being discharged from the liquid supply nozzle 482 and supplied to the contact member. In the present embodiment, the liquid supply nozzle 482 and the arm 474 are housed in the tray member 478. The drive mechanism 476 is configured to turn the liquid supply nozzle 482, the arm 474, and the tray member 478 together between the supply position and the retracted position. However, the drive mechanism 476 may be able to drive the liquid supply nozzle 482 and arm 474, and the tray member 478 separately.

Figure 4:
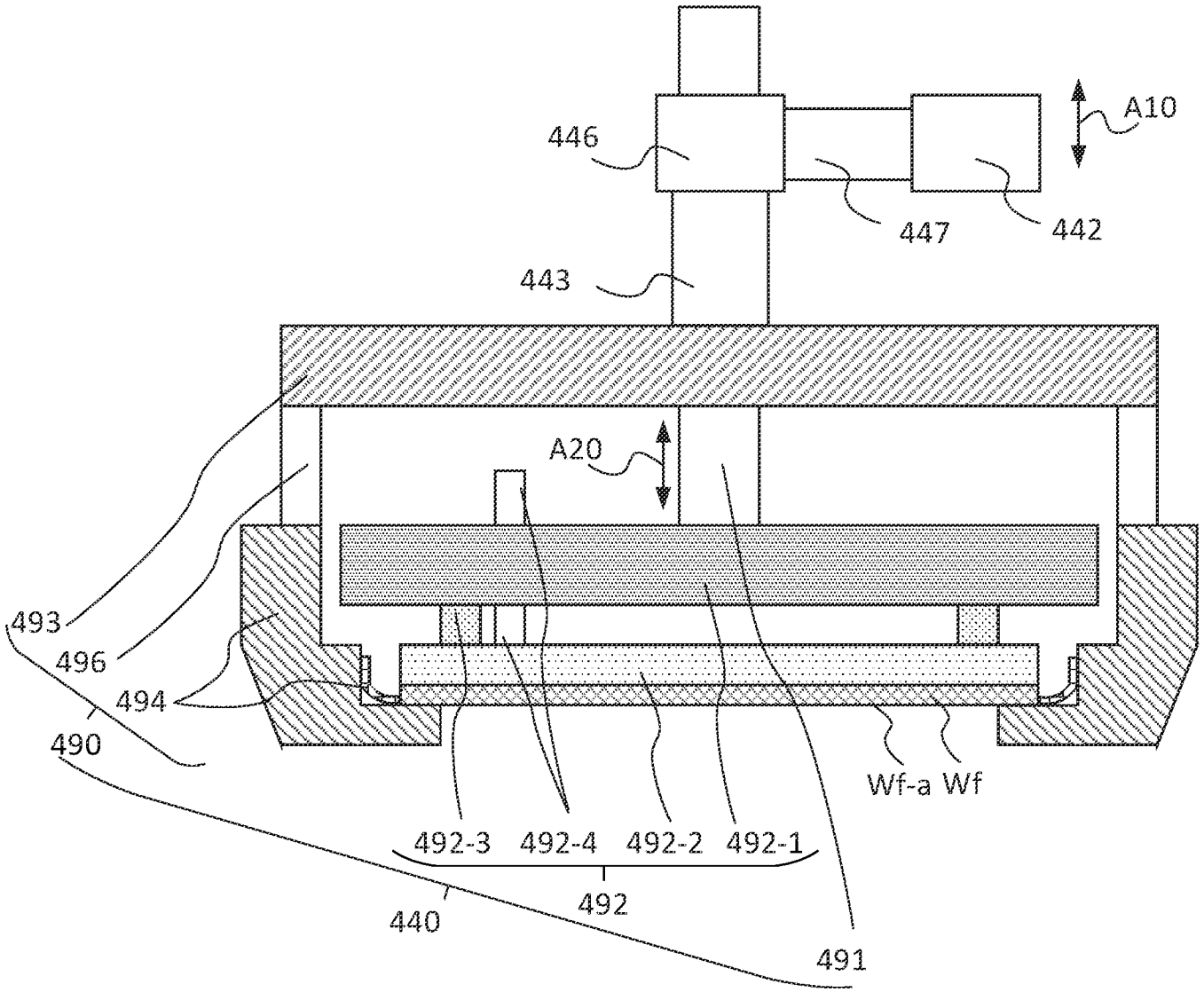
FIG. 4 is a sectional view schematically illustrating a substrate holder of the present embodiment.

FIG. 4 is a longitudinal sectional view schematically illustrating the substrate holder 440. The substrate holder 440 includes a supporter 490 that supports the substrate Wf, a back plate assembly 492 for sandwiching the substrate Wf together with the supporter 490, and a rotary shaft 491 extending vertically upward from the back plate assembly 492. The supporter 490 includes a first upper member 493, a second upper member 496, and a support mechanism 494 for supporting an outer peripheral portion of the surface to be plated Wf-a of the substrate Wf. The first upper member 493 holds the second upper member 496. In the illustrated example, the first upper member 493 extends in a substantially horizontal direction, and the second upper member 496 extends in a substantially vertical direction, which is not limited. The support mechanism 494 is an annular member having an opening in the center thereof for exposing the surface to be plated Wf-a of the substrate Wf and is suspended and held by the second upper member 496. The second upper member 496 can include one or more column members placed on an annular upper surface of the support mechanism 494.

The back plate assembly 492 includes a disc-shaped floating plate 492-2 for sandwiching the substrate Wf together with the support mechanism 494. The floating plate 492-2 is disposed on a back side of the surface to be plated Wf-a of the substrate Wf. The back plate assembly 492 includes a disc-shaped back plate 492-1 disposed above the floating plate 492-2. The back plate assembly 492 also includes a floating mechanism 492-4 for energizing the floating plate 492-2 in a direction apart from a back surface of the substrate Wf, and a pressing mechanism 492-3 for pressing the floating plate 492-2 to the back surface of the substrate Wf against an energizing force generated by the floating mechanism 492-4.

The floating mechanism 492-4 includes a compression spring attached between the back plate 492-1 and an upper end of a shaft extending upward from the floating plate 492-2 through the back plate 492-1. The floating mechanism 492-4 is configured to lift the floating plate 492-2 upward via the shaft with a compression reaction force of the compression spring and to energize the plate in a direction apart from the back surface of the substrate Wf. The floating mechanism 492-4 is not illustrated in the following drawings.

The pressing mechanism 492-3 is configured to press the floating plate 492-2 downward by supplying fluid to the floating plate 492-2 via a flow path formed inside the back plate 492-1. When fluid is supplied, the pressing mechanism 492-3 presses the substrate Wf to the support mechanism 494 with a force stronger than the energizing force of the floating mechanism 492-4.

The first elevating/lowering mechanism 442 elevates and lowers the entire substrate holder 440 (arrow A10). The plating module 400 further includes a second elevating/lowering mechanism 443. The second elevating/lowering mechanism 443 is driven by a known mechanism such as a direct-acting actuator to elevate and lower the rotary shaft 491 and the back plate assembly 492 with respect to the supporter 490 (arrow A20).

Figure 5:
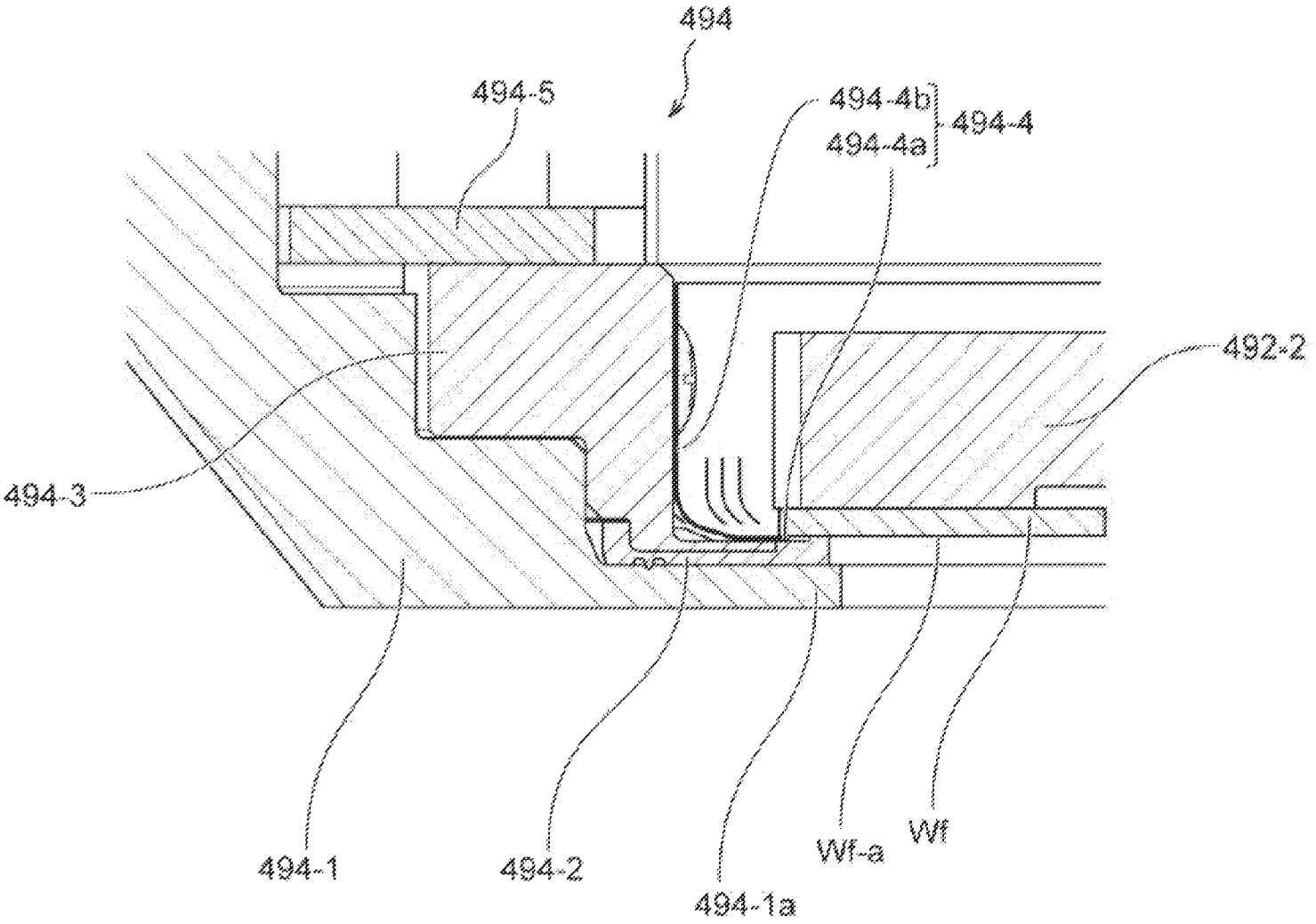
FIG. 5 is a sectional view of the substrate holder schematically illustrating a contact member of the present embodiment.

FIG. 5 is a longitudinal sectional view schematically illustrating an enlarged part of a configuration of the substrate holder 440. The support mechanism 494 includes an annular support member 494-1 for supporting the outer peripheral portion of the surface to be plated Wf-a of the substrate Wf. The support member 494-1 includes a flange 494-1*a* extending out to an outer peripheral portion of a lower surface of the back plate assembly 492 (floating plate 492-2). An annular sealing member 494-2 is disposed on the flange 494-1*a*. The sealing member 494-2 is an elastic member. The support member 494-1 supports the outer peripheral portion of the surface to be plated Wf-a of the substrate Wf via the sealing member 494-2. When the substrate Wf is plated, a portion between the support member 494-1 (substrate holder 440) and the substrate Wf is sealed by sandwiching the substrate Wf between the sealing member 494-2 and the floating plate 492-2.

The support mechanism 494 includes an annular base 494-3 attached to an inner peripheral surface of the support member 494-1 and an annular electrically conductive member 494-5 attached to an upper surface of the base 494-3. The base 494-3 is an electrically conductive member and can contain, for example, stainless steel or another metal. The electrically conductive member 494-5 is an electrically conductive annular member and can contain, for example, copper or another metal.

The support mechanism 494 includes a contact member 494-4 for supplying power to the substrate Wf. The contact member 494-4 is annularly attached to the inner peripheral surface of the base 494-3 with screws or the like. The contact member 494-4 has a shape that is not particularly limited while power can be supplied to the substrate Wf. For example, a plurality of arched contact members 494-4 may be disposed to be annularly arranged. The support member 494-1 holds the contact member 494-4 via the base 494-3. The contact member 494-4 is a member having an electrical conductivity for supplying power from an unillustrated power source to the substrate Wf held by the substrate holder 440. The contact member 494-4 includes a plurality of substrate contacts 494-4*a* that contact the outer peripheral portion of the surface to be plated Wf-a of the substrate Wf, and a main body portion 494-4*b* extending upward from the substrate contacts 494-4*a*. The contact member 494-4 conductively contacts the substrate Wf via the substrate contacts 494-4*a*.

Figure 6:
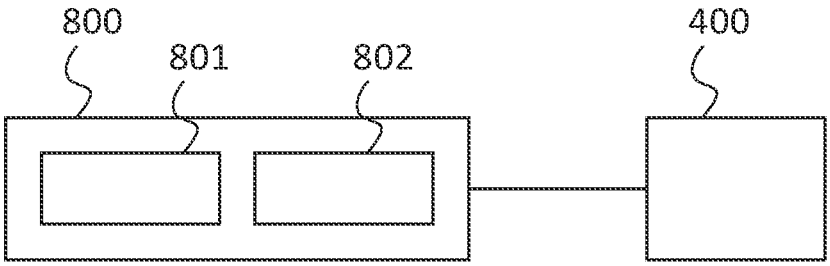
FIG. 6 is a conceptual diagram illustrating a configuration of a control module of the present embodiment.

FIG. 6 is a conceptual diagram for describing a control module 800. The control module 800 functions as a control device that controls an operation of the plating module 400. The control module 800 includes a computer such as a microcomputer, and this computer includes a CPU (central processing unit) 801 as a processor, a memory 802 as a temporary or non-transitory storage medium, and others. In the control module 800, the CPU 801 operates to control a part to be controlled of the plating module 400. The CPU 801 can perform various processes by executing a program stored in the memory 802 or by reading a program, stored in an unillustrated storage medium, into the memory 802 and executing the program. The program includes, for example, transfer control of the transfer robot or the transfer device, control of the process in each process module, control of the plating process in the plating module 400, a program that executes control of a liquid supply process, and a program for detecting abnormalities in various types of equipment. As the storage medium, for example, a memory such as a computer-readable ROM, RAM or flash memory, a disk storage medium such as a hard disk, CD-ROM, DVD-ROM or a flexible disk or a known medium such as a solid state drive may be used. The control module 800 is configured to be able to communicate with an unillustrated host controller that supervises and controls the plating apparatus 1000 and other related devices and can exchange data with a database possessed by the host controller. Some or all of functions of the control module 800 can be configured in hardware such as an ASIC. Some or all of the functions of the control module 800 may be configured by a PLC, a sequencer, or the like. A part or all of the control module 800 can be disposed inside and/or outside a housing of the plating apparatus. A part or all of the control module 800 is connected to be able to communicate with each part of the plating apparatus in a wired manner and/or a wireless manner.

Figure 7:
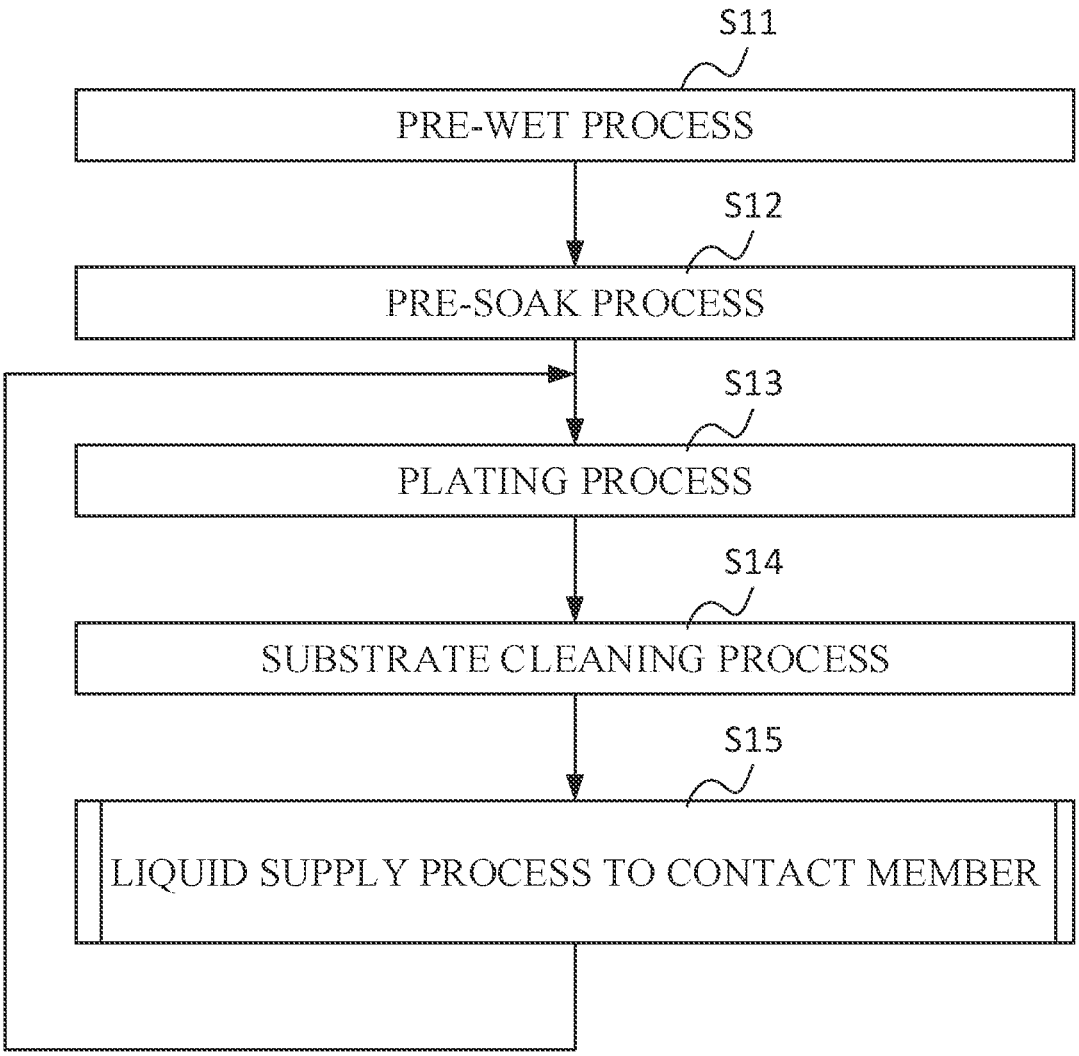
FIG. 7 is a flowchart illustrating a flow of a plating method of the present embodiment.

FIG. 7 is a flowchart showing a flow of a plating method of the present embodiment. This plating method is performed under control of the control module 800.

In step S11, in the pre-wet module 200, a pre-wet process is performed on the substrate Wf provided with the seed layer on the surface to be plated Wf-a. The pre-wet process includes wetting the surface to be plated Wf-a of the substrate Wf before the plating process, with a process liquid such as pure water or deaerated water, to replace air inside a resist pattern formed on the surface of the substrate with the process liquid. After step S11, step S12 is performed.

In step S12, in the pre-soak module 300, a pre-soak process is performed on the substrate Wf. In the pre-soak process, for example, an oxide film having a large electrical resistance that is present on the surface of the seed layer or the like is removed by etching with a process liquid such as sulfuric acid or hydrochloric acid to clean or activate the surface of the plating base layer. After the pre-soak process, the substrate Wf may be cleaned with a process liquid such as pure water or deaerated water. The substrate Wf subjected to the pre-wet process is wet with such process liquid, and an aperture of the resist pattern on the surface of the substrate Wf is filled with such process liquid. After step S12, step S13 is performed. Step S12 may not be performed, and the plating apparatus 1000 may not include the pre-soak module 300.

In step S13, the plating process is performed on the substrate Wf in the plating module 400. Under the control of the control module 800, the first elevating/lowering mechanism 442 and an unillustrated horizontal movement mechanism for moving the substrate holder 440 horizontally move the substrate holder 440 to a position of the substrate Wf, and the substrate Wf wetted with the process liquid in step S11 or S12 is attached to the substrate holder 440. At this time, in the substrate holder 440, the liquid L1 is supplied to the contact member 494-4 by step S15 described later, and at least a part of the contact member 494-4 is coated with the liquid L1. After the substrate Wf is attached to the substrate holder 440, the substrate holder 440 is lowered by the first elevating/lowering mechanism 442 and the substrate Wf is immersed in the plating solution. Thereafter, a voltage is applied between the anode 430 and the substrate Wf, and the plating process is performed.

In the plating process of the present embodiment, since the substrate contacts 494-4*a* or the like of the contact member 494-4 are covered with the liquid L1, power supply variation due to the local battery effect or shunt current is suppressed. Furthermore, when the substrate Wf is attached to the substrate holder 440 and if there are a wet portion and a dry portion in a region where the outer peripheral portion of the substrate Wf is in contact with the contact member 494-4, the power supply variation is caused. In the present embodiment, however, the variation is suppressed by uniformly coating the contact member 494-4 with the liquid L1. Further, for inhibiting generation of the wet portion and the dry portion, it is not necessary to dry the substrate Wf wetted by the pre-wet or pre-soak process, and plating defects can be prevented from being caused by this drying up to the surface to be plated Wf-a. In addition, the power supply variation due to local dirt in the region where the outer peripheral portion of the substrate Wf and the contact member 494-4 are in contact with each other can be suppressed by cleaning or coating the contact member 494-4 with the liquid L1. After step S13, step S14 is performed.

In step S14, a substrate cleaning process for cleaning the substrate Wf on which the plating process has been performed is performed. After the plating process, the substrate holder 440 is elevated above a liquid level of the plating solution in the plating tank 410, to clean the surface to be plated Wf-a of the substrate Wf with the cleaning solution supplied from an unillustrated cleaning solution nozzle. At this time, the substrate holder 440 and/or the cleaning solution nozzle may be rotated to uniformly apply the cleaning solution to the substrate Wf. By this substrate cleaning process, the plating solution adhering to the substrate Wf can be collected and reused as appropriate, and/or by wetting the surface to be plated Wf-a of the substrate Wf, the surface to be plated Wf-a can be prevented from being dried. The cleaning solution can be, for example, pure water, deaerated water, or liquid used in the pre-wet process, the pre-soak process, the cleaning process or another process. The substrate Wf subjected to the substrate cleaning process is removed from the substrate holder 440, transferred to the cleaning module 500 and the spin rinse dryer 600 in this order, subjected to the cleaning process and drying process, and then transferred to the cassette of the load port 100. After step S14, step S15 is performed.

Figure 8:
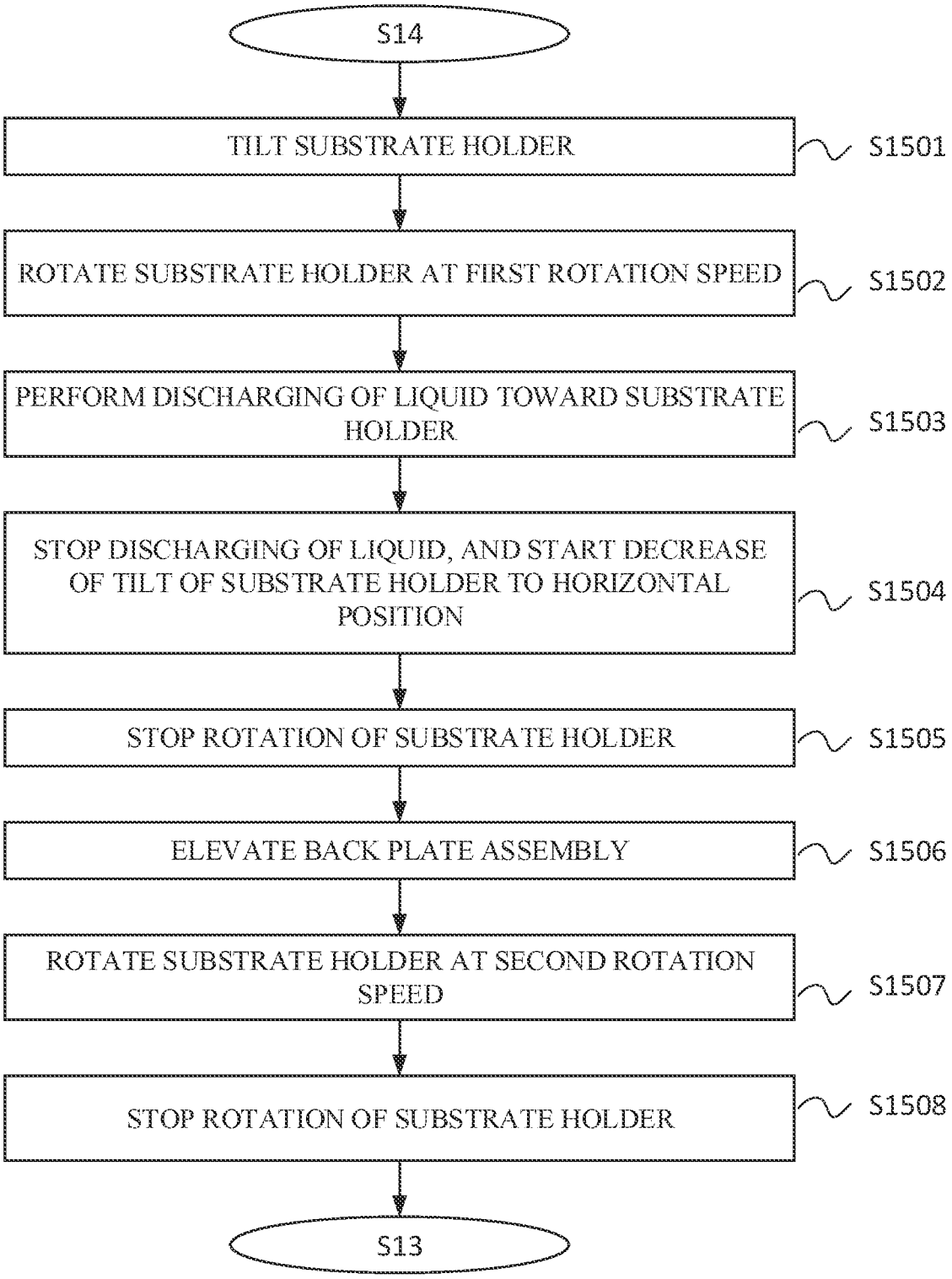
FIG. 8 is a flowchart illustrating a flow of a process of supplying liquid to the contact member in the present embodiment.

In step S15, the liquid supply process is performed to the contact member 494-4. FIG. 8 is a flowchart illustrating a flow of the liquid supply process. In step S1501, the control module 800 controls the tilting mechanism 447 to tilt the substrate holder 440 in which the substrate Wf is not disposed. If liquid L1 is supplied to the contact member 494-4 in step S1503 described later, an angle of tilt is not particularly limited. For example, the substrate holder 440 can be tilted to a state of being tilted by 3 to 7 degrees, preferably 5 degrees, from a horizontal state. Here, the tilt of the substrate holder 440 indicates the tilt of the substrate Wf that can be disposed on the substrate holder 440, and is represented by, for example, an angle of a lower surface of the floating plate 492-2 from the horizontal state.

Figure 9:
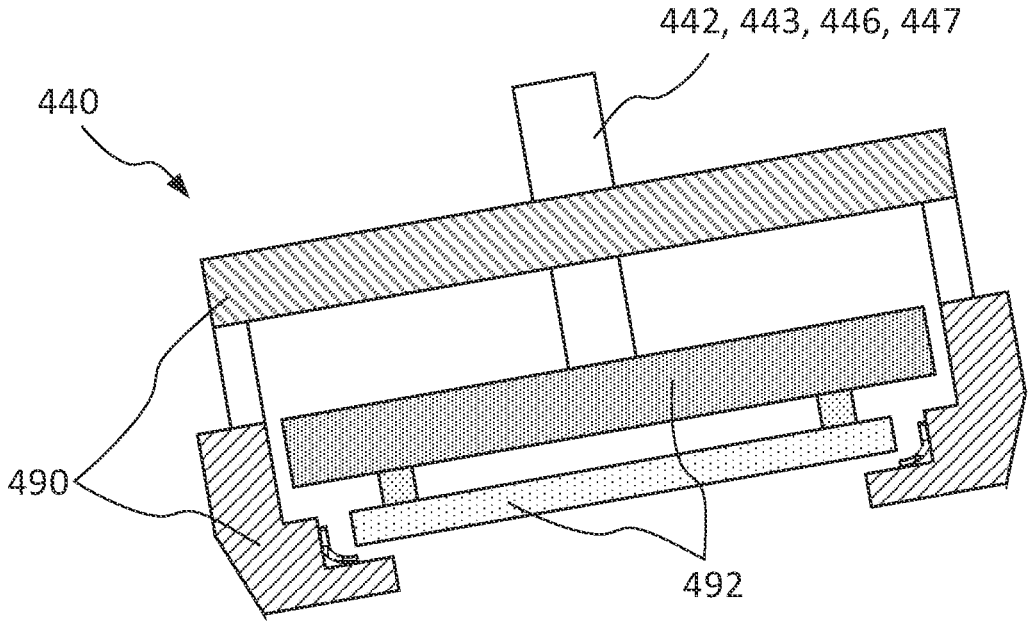
FIG. 9 is a sectional view schematically illustrating a step of tilting the substrate holder.

FIG. 9 is a conceptual diagram for describing step S1501. The tilting mechanism 447 tilts the entire substrate holder 440 including the supporter 490 and the back plate assembly 492. After step S1501, step S1502 is performed.

In step S1502, the control module 800 controls the rotation mechanism 446 to rotate the substrate holder 440 in a tilted state at a first rotation speed. Hereinafter, the rotation in step S1502 is called the first rotation. The first rotation speed is preferably 8 rpm or more, and more preferably 10 rpm or more. As the first rotation speed decreases, a large part of liquid L1 drops along the tilt due to gravity from the substrate holder 440, and the contact member 494-4 may not be sufficiently coated with the liquid L1. The first rotation speed is preferably 15 rpm or less, and more preferably 12 rpm or less. As the first rotation speed increases, overflown liquid L1 may be scattered over a wider range from a region where the contact member 494-4 above the sealing member 494-2 is disposed. In this case, the liquid L1 comes off the tray member 478 and drops into the plating tank 410, thereby causing an adverse effect such as diluting the plating solution. From these viewpoints, the first rotation speed is preferably 8 rpm or more and 15 rpm or less, and more preferably 10 rpm or more and 12 rpm or less.

Figure 10:
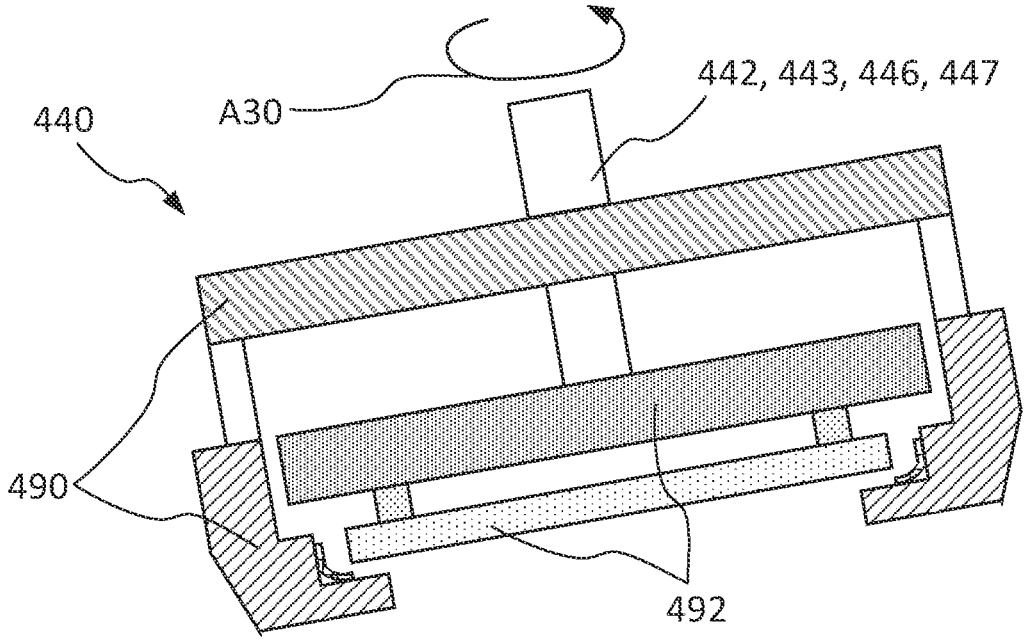
FIG. 10 is a sectional view schematically illustrating a step of rotating the substrate holder at a first rotation speed.

FIG. 10 is a conceptual diagram for describing step S1502. In FIG. 10, the first rotation of the substrate holder 440 is schematically illustrated with an arrow A30. After step S1502, step S1503 is performed.

In step S1503, the control module 800 controls the liquid supply device 470 to perform discharging of the liquid L1 toward the substrate holder 470. The discharging of the liquid L1 is performed to supply the liquid L1 to the contact member 494-4. For example, the liquid L1 is discharged from the liquid supply nozzle 482 toward the contact member 494-4 so that the liquid L1 directly hits the contact member 494-4. It is preferable that the substrate holder 440 makes at least one rotation at the first rotation speed while the liquid L1 is discharged. The supplied liquid L1 coats at least a part of the contact member 494-4.

Figure 11:
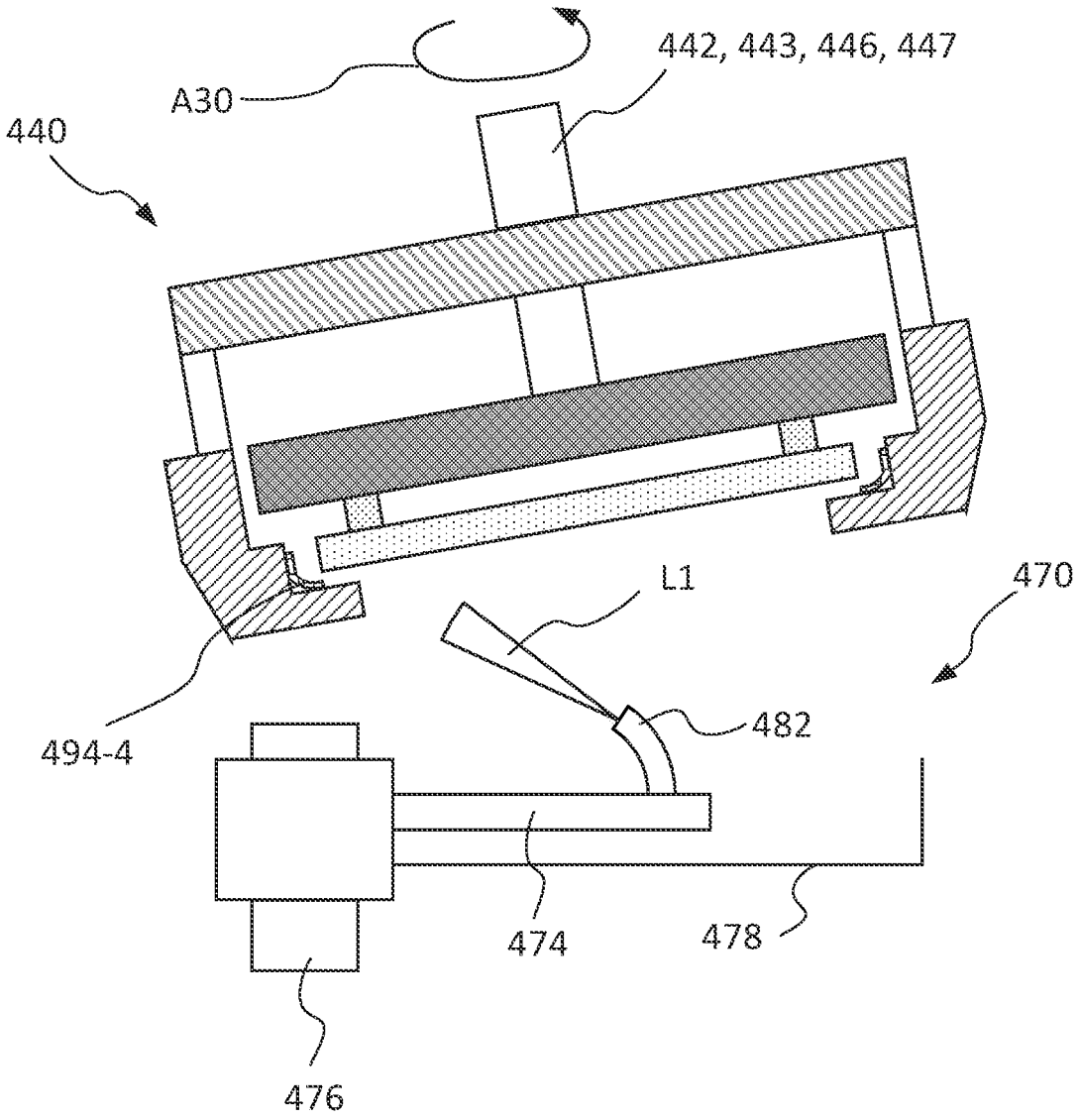
FIG. 11 is a sectional view schematically illustrating a step of discharging liquid toward the substrate holder.

FIG. 11 is a conceptual diagram for describing step S1503. When the arm 474 and the tray member 478 are driven by the drive device 476 and the liquid supply nozzle 482 moves to the supply position, the liquid L1 is discharged from the liquid supply nozzle 482 so that the liquid L1 is supplied to the contact member 494-4. After step S1503, step S1504 is performed. In step S1503, in addition to supplying liquid to the contact member 494-4, the contact member 494-4 can be cleaned with a simple configuration.

In step S1504, the control module 800 controls the liquid supply device 470 to stop the discharging of the liquid L1 and controls the tilting mechanism 447 to start decrease of the tilt of the substrate holder 440 to a horizontal position. This starting the decrease of the tilt of the substrate holder 440 is performed concurrently with or within a predetermined time before or after stopping the discharging of the liquid L1.

The step of stopping the discharging of the liquid L1 is called the discharge stopping step, and the step of starting decrease of the tilt of the substrate holder 440 is called the tilt decreasing step. After the discharge stopping step, when a certain amount of time elapses without performing the tilt decreasing step, the liquid L1 in contact with the contact member 494-4 drops from the tilted substrate holder 440 due to gravity, and the contact member 494-4 might not be sufficiently coated with the liquid L1. On the other hand, after the tilt decreasing step, when a certain amount of time elapses without performing the discharge stopping step, the discharged liquid L1 overflows from the substrate holder 440, comes off from the tray member 478, and drops into the plating tank 410, thereby diluting the plating solution. The predetermined time is preferably set in advance so that these problems do not occur. From this viewpoint, the predetermined time is preferably 2 seconds or less, more preferably 1 second or less, and furthermore preferably 0.5 seconds or less. It is more preferable that the discharge stopping step and the tilt decreasing step are performed substantially simultaneously.

Here, the horizontal position indicates, for example, a posture of the substrate holder 440 in which the tilt of the substrate holder 440 is, for example, less than 1 degree, though a degree of tilt is not particularly limited, when the contact member 494-4 in a sufficient range to form plating uniformly to a desired degree is coated with the liquid L1.

Figure 12:
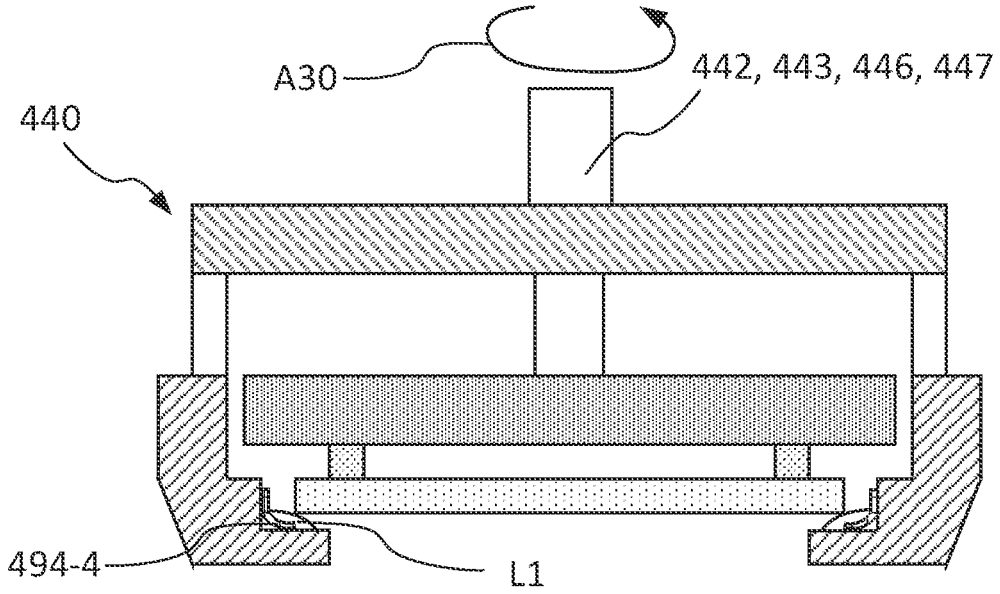
FIG. 12 is a sectional view schematically illustrating that tilt of the substrate holder is decreased and that the substrate holder is at a horizontal position.
Figure 13:
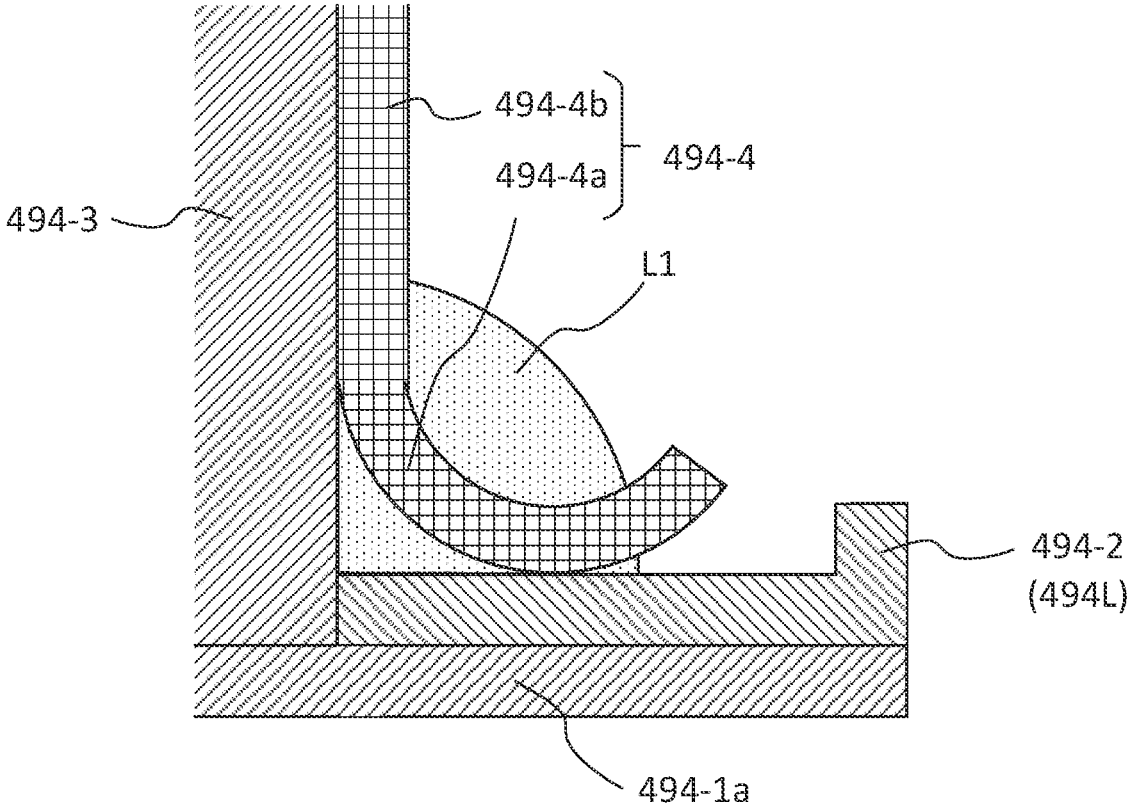
FIG. 13 is a sectional view schematically illustrating the liquid supplied to the contact member.

FIG. 12 is a conceptual diagram for describing the substrate holder 440 at the horizontal position after step S1504. FIG. 13 is an enlarged sectional view in the vicinity of the contact member 494-4 in FIG. 12. In an illustrated example, the liquid L1 is disposed in a space where the contact member 494-4 is disposed inside the base 494-3 above the flange 494-1*a* and the sealing member 494-2. In the illustrated example, the sealing member 494-2 functions as a liquid holding portion 494L that holds the liquid L1 in contact with the contact member 494-4. The liquid holding portion 494L is not limited to this example while holding the liquid L1 in contact with the contact member 494-4. Immediately after step S1504, the liquid L1 is in contact with a part of the contact member 494-4 but is not uniformly distributed and the substrate contacts 494-4*a* may not be sufficiently coated. In this case, if the substrate Wf is brought into contact with the contact member 494-4 and attached to the substrate holder 440, the power supply variation due to the local battery effect, shunt current or the like may be caused. After step S1504, step S1505 is performed.

In step S1505, the control module 800 controls the rotation mechanism 446 to stop rotation of the substrate holder 440. After step S1505, step S1506 is performed.

In step S1506, the control module 800 controls the second elevating/lowering mechanism 443 to elevate the back plate assembly 492. The back plate assembly 492 is elevated with respect to the supporter 490. When the liquid L1 contacts the back plate assembly 492 or the like, the liquid L1 becomes nonuniformly distributed due to surface tension in step S1507 described later, and the contact member 494-4 is not uniformly coated, causing the power supply variation. This step increases a distance between the back plate assembly 492 and the contact member 494-4 and makes it difficult for the liquid L1 in contact with the contact member 494-4 to contact, for example, the floating plate 492-2 of the back plate assembly 492. For this reason, when the substrate holder 440 is rotated at a second rotation speed in step S1507 described later, the liquid L1 accumulated in the liquid holding portion 494L is more uniformly distributed around a circumference as a whole due to centrifugal force, and the contact member 494-4 is more uniformly coated. In addition to the back plate assembly 492, another member facing the contact member 494-4 can be moved apart from the contact member 494.

After step S1506, step S1507 is performed. If the plating can be uniformly formed to a desired degree, step S1505 and step S1506 may not be performed.

In step S1507, the control module 800 controls the rotation mechanism 446 to rotate the substrate holder 440 at the second rotation speed. This rotation is called second rotation. The second rotation speed is set to a speed higher than the first rotation speed. Here, the first rotation speed and the second rotation speed are set to positive values indicating a magnitude of the rotation speed without being affected by an orientation of rotation. The first rotation and the second rotation may have the same orientation or opposite orientations.

The first rotation speed may be set to the rotation speed from the viewpoint described in step S1502, but as described with reference to FIG. 13, the contact member 494-4 may not be sufficiently coated with the liquid L1. The inventors have found that the contact member 494-4 can be more uniformly covered with the liquid L1 by rotating the substrate holder 440 at the second rotation speed higher than the first rotation speed. From this viewpoint, the second rotation speed is preferably 30 rpm or more. From the similar viewpoint and since power is used inefficiently at an excessively high second rotation speed, for example, the second rotation speed is more preferably set to 40 rpm or more and 60 rpm or less.

Figure 14:
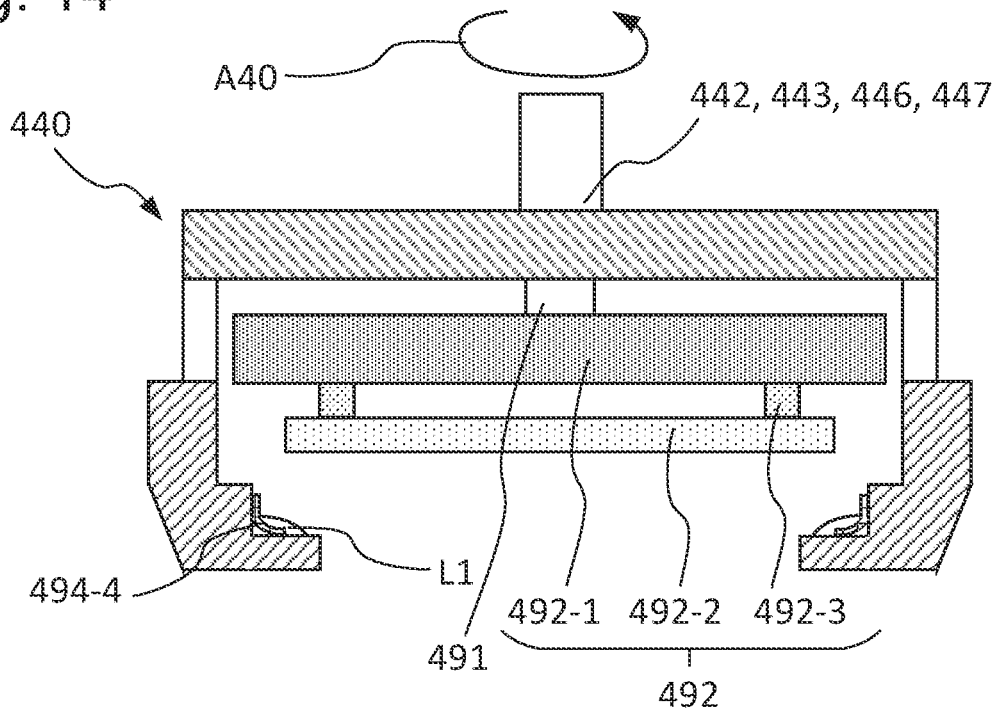
FIG. 14 is a sectional view schematically illustrating the step of rotating the substrate holder at the first rotation speed.

FIG. 14 is a conceptual diagram for describing the substrate holder 440 in step S1507. In step S1507, the substrate holder 440 at the horizontal position is rotated at the second rotation speed. The second rotation is schematically illustrated with an arrow A40. In an illustrated example, since the back plate assembly 492 is elevated in step S1506, a space where any members are not present is expanded in the vicinity of the contact member 494-4, and bias of the liquid L1 due to contact between the liquid L1 and the other member can be suppressed. When step S1506 is not performed, the second rotation is performed while the back plate assembly 492 remains lowered, and also in this case, a certain effect of suppressing the bias of the liquid L1 can be obtained.

Figure 15:
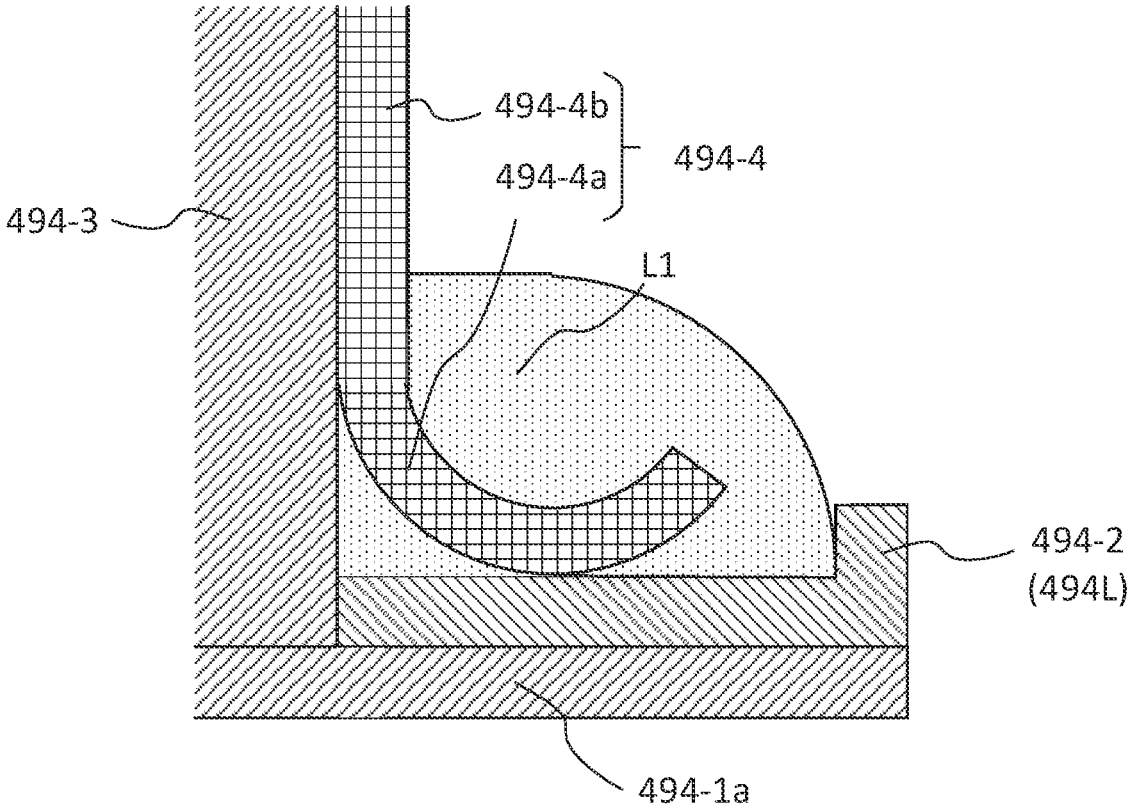
FIG. 15 is a sectional view schematically illustrating the liquid supplied to the contact member.

FIG. 15 is an enlarged sectional view in the vicinity of the contact member 494-4 after step S1507. As a result of the second rotation, the contact member 494-4 is coated with the liquid L1 over a wider range while suppressing the bias. For example, over the entire annular contact member 494-4, the substrate contacts 494-4*a* can be coated with the liquid L1. After step S1507, step S1508 is performed.

In step S1508, the control module 800 controls the rotation mechanism 446 to stop the second rotation of the substrate holder 440. After step S1508, step S13 (FIG. 7) is performed.

In the plating apparatus and plating method of the present embodiment, the control module 800 tilts the substrate holder 440, rotates the substrate holder 440 at the first rotation speed while the substrate holder 440 is tilted, discharges the liquid L1 toward the substrate holder 440 rotating at the first rotation speed to supply the liquid L1 to the contact member 494-4, stops the discharging of the liquid L1, starts decrease of the tilt of the substrate holder 440 to the horizontal position concurrently with or within the predetermined time before or after stopping the discharging of the liquid L1, rotates the substrate holder 440 at the second rotation speed higher than the first rotation speed while the substrate holder 440 is at the horizontal position, stops the rotation of the substrate holder 440 at the second rotation speed, attaches the substrate Wf to the substrate holder 440 stopped from being rotated, and performs the plating process on the attached substrate Wf. This can reduce the power supply variation during the plating process more reliably without requiring any complicated work and can improve uniformity of a thickness of the plating formed on the substrate Wf.

The following modifications are also within the scope of the present invention and can be combined with the above-described embodiment or other modifications. In the following modifications, parts exhibiting the same structure, function, and the like as in the above-described embodiment are denoted with the same reference numeral, and description thereof is not repeated as appropriate.

Modification 1

In step S1503 of the above-described embodiment, the liquid L1 may be discharged toward the back plate assembly 492. In particular, the liquid supply nozzle 482 can discharge the liquid L1 toward the floating plate 492-2, which is a plate that presses the substrate Wf when the substrate Wf is disposed on the substrate holder 440.

Figure 16:
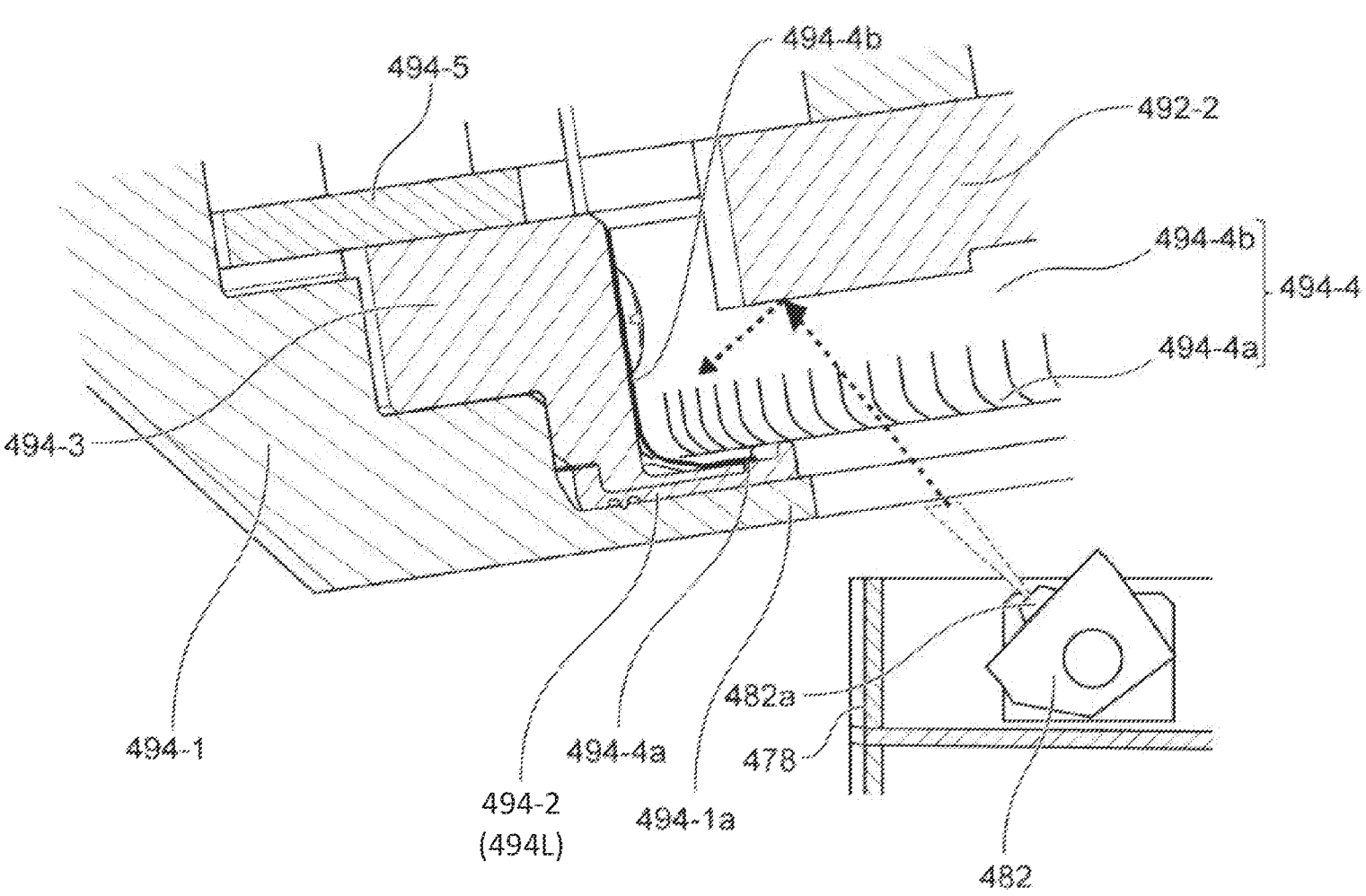
FIG. 16 is a sectional view schematically illustrating discharge of liquid to a substrate holder in Modification 1.

FIG. 16 is a sectional view schematically illustrating a liquid supply method to the contact member 494-4 by the plating method of this modification. In step S1503, the floating plate 492-2 of the back plate assembly 492 can be disposed at a position surrounded with the contact member 494-4. The liquid supply nozzle 482 is configured to discharge the liquid L1 from a discharge port 482*a* toward the lower surface of the back plate assembly 492 so that the liquid L1 hitting and bouncing off the lower surface of the back plate assembly 492 flows toward the main body portion 494-4*b*. The liquid L1 that has hit and bounced off the lower surface of the backplate assembly 492 collides with the main body portion 494-4*b* and then flows downward from the main body portion 494-4*b* due to gravity. This allows the liquid L to flow into the liquid holding portion 494L. Alternatively, the plating solution adhering to the main body portion 494-4*b* and the substrate contacts 494-4*a* drops together with the liquid L1 and is collected in the tray member 478.

According to the present modification, as in the above embodiment, the power supply variation during the plating process can be reduced more reliably without requiring any complicated work. In addition, according to the present modification, rust can be inhibited from being generated on a metal member (for example, the electrically conductive member 494-5) attached to the substrate holder 440. That is, in a technique of disposing a liquid supply nozzle 482 above or to the side of the contact member 494-4 when supplying the liquid L1 to the contact member 494-4, the liquid supply nozzle 482 and the back plate assembly 492 might contact each other, and hence the back plate assembly 492 is retracted to a higher position. Then, the liquid L1 discharged from the liquid supply nozzle 482 to collide with the contact member 494-4 jumps up and down to adhere to the metal member (for example, the electrically conductive member 494-5), and rust might be generated. In order to prevent the liquid L1 jumping up and down from being adhered to the metal member, it is unfavorably necessary to precisely control an arrangement position of the liquid supply nozzle 482, a discharge angle of the liquid L1, a discharge intensity of the liquid L1, and the like.

On the other hand, in this modification, the liquid supply nozzle 482 is disposed below the substrate holder 440, to discharge the liquid L1 from below the substrate holder 440. Therefore, a space is made at the position surrounded with the contact member 494-4, and hence the back plate assembly 492 can be disposed in this space. As illustrated in FIG. 16, the back plate assembly 492 serves as a wall for the metal member (for example, the electrically conductive member 494-5) above the contact member 494-4, and hence the liquid L1 discharged from the liquid supply nozzle 482 can be prevented from jumping up and down on the metal member. As a result, according to the present modification, the liquid L1 can be easily supplied to the contact member 494-4 without any need to precisely control the arrangement position of the liquid supply nozzle 482, the discharge angle of the liquid L1, the discharge intensity of the liquid L1, and the like.

Modification 2

In the above-described embodiment, the liquid supply nozzle 482 may be a straight nozzle.

Figure 17:
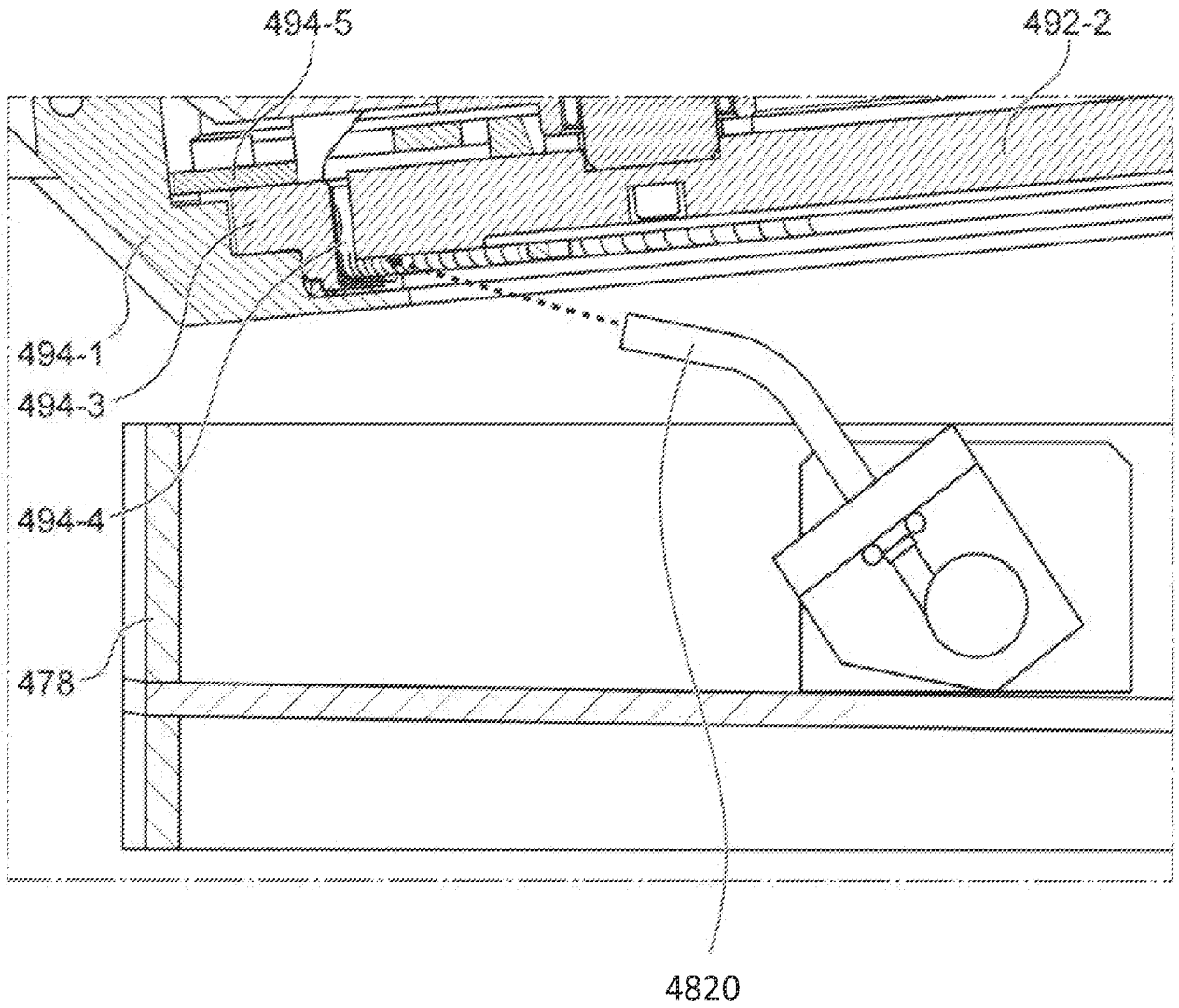
FIG. 17 is a sectional view schematically illustrating discharge of liquid to a substrate holder in Modification 2.

FIG. 17 is a diagram schematically illustrating a liquid supply nozzle 4820 of this modification. As illustrated in FIG. 17, the liquid supply nozzle 4820 is a straight nozzle that linearly discharges the liquid L1. By using the straight nozzle, the liquid L1 can be discharged to a target position of the main body portion 494-4*b* of the contact member 494-4. In an illustrated example, the liquid L1 is discharged from the liquid supply nozzle 4820 so that the liquid L1 directly hits the contact member 494-4.

Modification 3

In the above-described embodiment, the rotation orientation or the like of the substrate holder 440 when discharging the liquid L1 may be adjusted.

Figure 18:
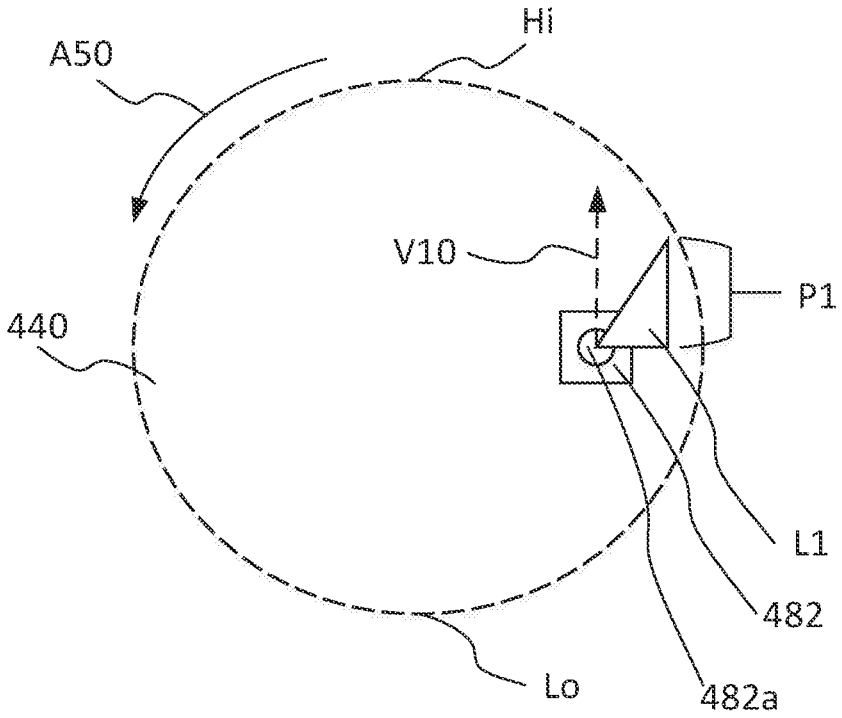
FIG. 18 is a plan view schematically illustrating discharge of liquid to a substrate holder in Modification 3.
Figure 19:
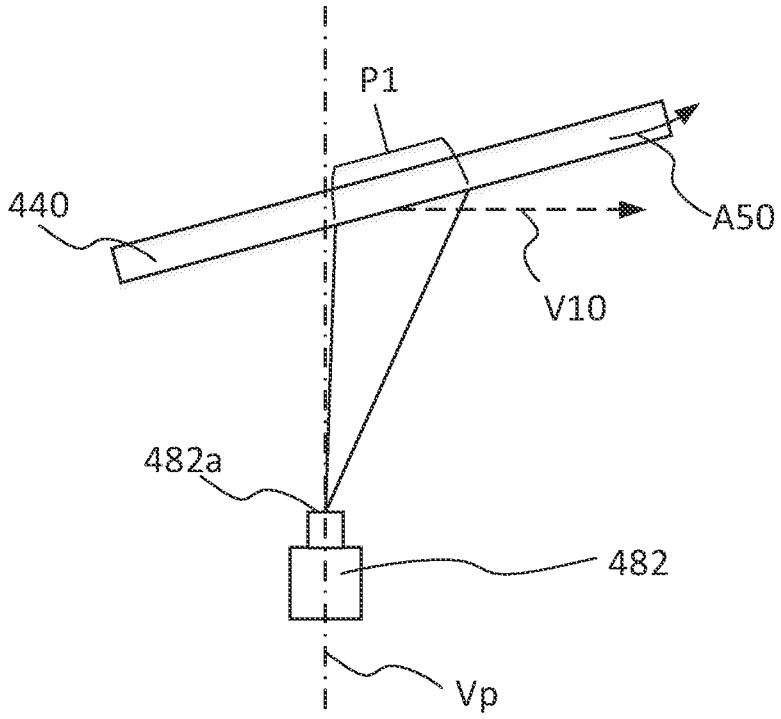
FIG. 19 is a side view schematically illustrating the discharge of liquid to the substrate holder in Modification 3.

FIGS. 18 and 19 are a plan view and a side view respectively schematically illustrating the discharging of the liquid L1 in step S1503 in the present modification. FIG. 18 schematically illustrates the substrate holder 440 seen from an upper side in a vertical direction with a dashed circle. In an illustrated example, the substrate holder 440 is rotated counterclockwise (arrow A50). In the tilted substrate holder 440, an upper end of tilt is indicated as an upper end Hi, and a lower end of the tilt is indicated as a lower end Lo.

A position where the discharged liquid L1 collides with the substrate holder 440 is indicated as a collision position P1. In the first rotation of the substrate holder 440, the holder is preferably rotated so as to have a speed component in an orientation from the lower end Lo toward the upper end Hi of the tilted substrate holder 440 at the collision position P1. This makes it difficult to give a downward speed component to the liquid L1 and makes it easy for the liquid L1 to accumulate in the liquid holding portion 494L so as to coat the contact member 494-4. In the illustrated example, in a semicircle on the right side of the substrate holder 440 in the drawing, the substrate holder 440 has the speed component from the lower end Lo to the upper end Hi, and the collision position PI is disposed in the semicircle.

Further, it is preferable that the liquid L1 is discharged so as to have the speed component in the same orientation as the rotation orientation of the substrate holder 440 at the collision position P1. This makes it easy for the liquid L1 to move to the liquid holding portion 494L and further makes it easy for the liquid L1 to accumulate so as to cover the contact member 494-4. In the illustrated example, the liquid L1 is discharged so as to have a speed component (arrow V10) in an orientation toward the upper end Hi and is configured to have a speed component in the same orientation as the rotation orientation at the collision position PI of the substrate holder 440.

It is preferable that the liquid L1 is discharged so as to spread in a semi-fan shape from the discharge port 482*a* of the liquid supply nozzle 482. More specifically, the liquid L1 spreads along a plane extending from the discharge port 482*a* toward an upper end Hi side. Therefore, the discharged liquid L1 is distributed in a space on one side of a vertical plane Vp through the discharge port 482*a*. With such a configuration, more liquid L1 can be discharged in a manner of easily accumulating in the liquid holding portion 494L.

Modification 4

In the above-described embodiment, the plating module 400 may include a covering member that inhibits a plating solution atmosphere in the plating tank 410 from being released into the plating module 400 when the liquid L1 is supplied to the contact member 494-4. The covering member can be, for example, a cylindrical member surrounding the substrate holder 440. At least two of the liquid supply nozzle 482, the covering member, and the cleaning solution nozzle for cleaning the substrate Wf may be integrally configured.

The present invention can be described in the following aspects.

[Aspect 1] According to Aspect 1, a plating method is provided for performing a plating process of a substrate with a plating apparatus including a substrate holder including a contact member that conductively contacts the substrate. The plating method includes a step of tilting the substrate holder, a step of rotating the substrate holder at a first rotation speed while the substrate holder is tilted, a step of performing discharging of liquid toward the substrate holder rotating at the first rotation speed to supply the liquid to the contact member, a step of stopping the discharging of the liquid, a step of starting decrease of tilt of the substrate holder to a horizontal position concurrently with or within a predetermined time before or after stopping the discharging of the liquid, a step of rotating the substrate holder at a second rotation speed higher than the first rotation speed while the substrate holder is at the horizontal position, a step of stopping rotation of the substrate holder at the second rotation speed, a step of attaching the substrate to the substrate holder that is stopped from being rotated, and a step of performing the plating process on the attached substrate. According to Aspect 1, power supply variation can be reduced during the plating process more reliably without requiring any complicated work, and uniformity of a thickness of plating formed on the substrate can be improved.

[Aspect 2] According to Aspect 2, in Aspect 1, the predetermined time is 2 seconds or less. According to Aspect 2, while inhibiting the liquid from dropping from a liquid holding portion in the vicinity of the contact member, the liquid can be inhibited from overflowing from the substrate holder 440 and diluting a plating solution.

[Aspect 3] According to Aspect 3, in Aspect 1 or 2, the second rotation speed is 30 rpm or more. According to Aspect 3, the contact member can be covered with the liquid L1 more uniformly, and power supply variation during the plating process can be further reduced.

[Aspect 4] According to Aspect 4, in any of Aspects 1 to 3, the first rotation speed is 8 rpm or more and 15 rpm or less. According to Aspect 4, while inhibiting the liquid from dropping from the liquid holding portion in the vicinity of the contact member, the liquid can be inhibited from scattering from the substrate holder and diluting the plating solution.

[Aspect 5] According to Aspect 5, in any of Aspects 1 to 4, the method further includes a step of, after the substrate holder is placed at the horizontal position, moving another member that faces the contact member in the substrate holder apart from the contact member, before rotating the substrate holder at the second rotation speed. According to Aspect 5, the liquid can be inhibited from being biased due to contact with the other member when distributed, and the contact member can be inhibited from being nonuniformly coated and causing the power supply variation.

[Aspect 6] According to Aspect 6, in any of Aspects 1 to 5, in the step of performing the discharging of the liquid, the liquid is discharged toward a plate that presses the substrate when the substrate is disposed in the substrate holder. According to Aspect 6, rust can be inhibited from being generated on a metal member attached to the substrate holder due to the liquid that adheres.

[Aspect 7] According to Aspect 7, in any of Aspects 1 to 6, in the step of performing the discharging of the liquid, the substrate holder is rotated to have a speed component in an orientation from a lower end toward an upper end of the tilted substrate holder at a collision position of the substrate holder with which the discharged liquid collides. According to Aspect 7, it is difficult to give a downward speed component to the liquid that collides with the substrate holder, and it is easy for the liquid to accumulate so as to coat the contact member.

[Aspect 8] According to Aspect 8, in Aspect 7, in the step of performing the discharging of the liquid, the liquid is discharged to have a speed component in the same orientation as a rotation orientation of the substrate holder at the collision position. According to Aspect 8, it is easy for the liquid that collides with the substrate holder to move to the contact member, and it is easier for the liquid to accumulate so as to coat the contact member.

[Aspect 9] According to Aspect 9, in Aspect 8, in the step of performing the discharging of the liquid, the liquid is discharged from a discharge port along a plane extending toward an upper end side of the substrate holder. According to Aspect 9, more liquid can be discharged in a manner of easily accumulating in the liquid holding portion in the vicinity of the contact member.

[Aspect 10] According to Aspect 10, in any of Aspects 1 to 9, the liquid has an electrical conductivity with a value equal to or less than a predetermined value or is deaerated. According to Aspect 10, power supply variation due to shunt current or local battery effect can be suppressed.

[Aspect 11] According to Aspect 11, a plating apparatus is provided including a substrate holder including a contact member that is in conductive contact with a substrate, and a control device, and the control device is configured to tilt the substrate holder, rotate the substrate holder at a first rotation speed while the substrate holder is tilted, perform discharging of liquid toward the substrate holder rotating at the first rotation speed to supply the liquid to the contact member, stop the discharging of the liquid, start decrease of tilt of the substrate holder to a horizontal position concurrently with or within a predetermined time before or after stopping the discharging of the liquid, rotate the substrate holder at a second rotation speed higher than the first rotation speed while the substrate holder is at the horizontal position, stop rotation of the substrate holder at the second rotation speed, attach the substrate to the substrate holder that is stopped from being rotated, and perform the plating process on the attached substrate. According to Aspect 11, the power supply variation can be reduced during the plating process more reliably without requiring any complicated work, and the uniformity of the thickness of the plating formed on the substrate can be improved.

Although the embodiments of the present invention have been described above based on some examples, the described embodiments are for the purpose of facilitating the understanding of the present invention and are not intended to limit the present invention. The present invention may be modified and improved without departing from the spirit thereof, and the invention includes equivalents thereof. In addition, the embodiments and modifications can be arbitrarily combined, or the elements described in the claims and the specification can be arbitrarily combined or omitted within a range in which the above-mentioned problems are at least partially solved, or within a range in which at least a part of the advantages is achieved.

REFERENCE SIGNS LIST

400 plating module
410 plating tank
440 substrate holder
442 first elevating/lowering mechanism
443 second elevating/lowering mechanism
446 rotation mechanism
447 tilting mechanism
470 cleaning device
482, 4820 liquid supply nozzle
482*a* discharge port
490 supporter
491 rotary shaft
492 back plate assembly
492-1 back plate
492-2 floating plate
494 support mechanism
494L liquid holding portion
494-1 support member
494-2 sealing member
494-4 contact member
494-4*a* substrate contact
494-4*b* main body portion
800 control module
1000 plating apparatus
L1 liquid
P1 collision position
Wf substrate
Wf-a surface to be plated

What is claimed is:

1. A plating method for performing a plating process of a substrate with a plating apparatus comprising a substrate holder including a contact member that conductively contacts the substrate, the plating method comprising:

a step of tilting the substrate holder, a step of rotating the substrate holder at a first rotation speed while the substrate holder is tilted, a step of performing discharging of liquid toward the substrate holder rotating at the first rotation speed to supply the liquid to the contact member, a step of stopping the discharging of the liquid, a step of starting decrease of tilt of the substrate holder to a horizontal position concurrently with or within a predetermined time before or after stopping the discharging of the liquid, a step of rotating the substrate holder at a second rotation speed higher than the first rotation speed while the substrate holder is at the horizontal position, a step of stopping rotation of the substrate holder at the second rotation speed, a step of attaching the substrate to the substrate holder that is stopped from being rotated, and a step of performing the plating process on the attached substrate.

2. The plating method according to claim 1, wherein the predetermined time is 2 seconds or less.

3. The plating method according to claim 1, wherein the second rotation speed is 30 rpm or more.

4. The plating method according to claim 1, wherein the first rotation speed is 8 rpm or more and 15 rpm or less.

5. The plating method according to claim 1, further comprising:

a step of, after the substrate holder is placed at the horizontal position, moving another member that faces the contact member in the substrate holder apart from the contact member, before rotating the substrate holder at the second rotation speed.

6. The plating method according to claim 1, wherein in the step of performing the discharging of the liquid, the liquid is discharged toward a plate that presses the substrate when the substrate is disposed in the substrate holder.

7. The plating method according to claim 1, wherein in the step of performing the discharging of the liquid, the substrate holder is rotated to have a speed component in an orientation from a lower end toward an upper end of the tilted substrate holder at a collision position of the substrate holder with which the discharged liquid collides.

8. The plating method according to claim 7, wherein in the step of performing the discharging of the liquid, the liquid is discharged to have a speed component in the same orientation as a rotation orientation of the substrate holder at the collision position.

9. The plating method according to claim 8, wherein in the step of performing the discharging of the liquid, the liquid is discharged from a discharge port along a plane extending toward an upper end side of the substrate holder.

10. The plating method according to claim 1, wherein the liquid has an electrical conductivity with a value equal to or less than a predetermined value or is deaerated.

* * * * *